US008408674B1

(12) United States Patent
Crowley

(10) Patent No.: US 8,408,674 B1
(45) Date of Patent: Apr. 2, 2013

(54) SYSTEM AND METHOD FOR INCORPORATING INKJET PRINTING INTO A PRINTING PRESS PROCESS

(76) Inventor: H. W. Crowley, Eliot, ME (US)

( * ) Notice: Subject to any disclaimer, the term of this patent is extended or adjusted under 35 U.S.C. 154(b) by 501 days.

(21) Appl. No.: 12/603,108

(22) Filed: Oct. 21, 2009

Related U.S. Application Data

(60) Provisional application No. 61/107,330, filed on Oct. 21, 2008.

(51) Int. Cl.
*B41J 23/00* (2006.01)

(52) U.S. Cl. ..... 347/37

(58) Field of Classification Search ..... None
See application file for complete search history.

(56) References Cited

U.S. PATENT DOCUMENTS 6,532,869 B2 * 3/2003 Aoyama et al. ..... 101/177
2008/0092377 A1 * 4/2008 Heitzinger ..... 29/846

* cited by examiner

*Primary Examiner* — Matthew Luu
*Assistant Examiner* — Erica Lin
(74) *Attorney, Agent, or Firm* — Loginov & Associates, PLLC; William A. Loginov

(57) ABSTRACT

This invention provides an inkjet print engine in combination with a conventional lithographic printing press so as to allow variable information to be applied to the fed sheets. Such information can include, but is not limited to, address information for mailing and/or special messages to the recipient. The system and method locates an inkjet printing head (single-color or multi-color) with respect to one of a number of locations along the print path. More particularly, the inkjet head can be located on a transverse carriage with movement is controlled by a conventional print head controller. The controller also addresses the formation of print at the head in conjunction with the movement of the carriage and also with respect to the movement of the sheet through the printing press. The locations at which the inkjet assembly can be located include the upstream or downstream blanket or plate rollers, the sheet in the region of the impression roller, the infeed region or the outfeed region.

14 Claims, 6 Drawing Sheets

SYSTEM AND METHOD FOR INCORPORATING INKJET PRINTING INTO A PRINTING PRESS PROCESS

RELATED APPLICATION

This application claims the benefit of U.S. Provisional Application Ser. No. 61/107,330, filed Oct. 21, 2008, entitled SYSTEM AND METHOD FOR INCORPORATING INKJET PRINTING INTO A PRINTING PRESS PROCESS, the entire disclosure of which is herein incorporated by reference.

FIELD OF THE INVENTION

This invention relates to printing processes using a printing press.

BACKGROUND OF THE INVENTION

More than one half of all printed products go in the mail. All items that go in the mail need addressing. Certain mailed items, such as post cards, folded and tabbed (or glued) flyers, and envelopes require the address affixed directly to them. It is also usual to print static messages and graphics on these items.

The current procedure in the direct-mail industry and prevalent for the last 25 years is to print the items on a traditional printing press and then put them on a subsequent addressing process that has a feeder and addressing capabilities. For the last 20 years the most common form of addressing has been inkjet printers attached to a material transport tables with material feeders. Companies such as MCS of Gaithersburg, Md., Secap of Conshohocken, Pa., Kirk-Rudy, Inc. of Woodstock, Ga., and Bryce Corporation of Memphis, Tenn., to name but a few suppliers/manufacturers, have offered such stand-alone printing and addressing systems for years. However, the two stages of first printing the items and then moving them to different equipment are very inefficient.

In the last 15 years there has been a dramatic increase in full-color, fully variable printing, mostly employing electronic printing with toner or inkjet. A typical and successful product is IGEN available from Xerox Corporation. This machine produces photographic printing that is fully variable. There have also been recent introductions of full-color inkjet presses. However, these printing processes are not yet as fast, as cheap or as prevalent as traditional printing presses utilizing offset techniques with, for example, printing plates.

Unlike traditional printing where each image is fixed by what is contained on the plate, with inkjet every image is unique. It is desirable to provide a technique that allows for the addition of variable information the traditional printing presses. One approach to providing such variable information is to locate a traditional mail table in line with a sheet-fed press so that the appropriate information can be added at this station (located, for example, upstream of the press). However, such an inline configuration requires a substantial increase in floor-space at the work area, and many extra components are required to fetch and accurately register the fed sheets with respect to the printing press.

It is recognized that inkjet print engine can make any location on the medium different from image to image. There are several patents that reveal new inventions by applying inkjet prior to a plate section in lithographic printing. For example, U.S. Pat. No. 4,833,486 applies inkjet printing to modify the ink receptor capabilities of the plate. Related patents make the image plate more oleophilic meaning "ink loving" or "oil loving" and hydrophobic (or ink-phobic) meaning "water shedding". This use of inkjet on the plate is only to modify or condition the paper substrate to better receive ink from the plate, however, none of these patents contemplate making the image variable from impression to impression.

SUMMARY OF THE INVENTION

This invention overcomes the disadvantages of the prior art by employing an inkjet print engine in combination with a conventional lithographic printing press so as to allow variable information to be applied to the fed sheets. Such information can include, but is not limited to, address information for mailing and/or special messages to the recipient. The system and method locates an inkjet printing head (single-color or multi-color) with respect to one of a number of locations along the print path. More particularly, the inkjet head can be located on a transverse carriage with printing location controlled by a conventional inkjet print head controller. The controller addresses the formation of print at the head with respect to the movement of the image through the printing press by use of incremental encoder and a start-of-page reference signal. Print heads that can print ½ inch wide and up to any width at one time are used in an illustrative embodiment, but a variety of other arrangements, including an array of stitched-together heads that operate in concert can be alternatively employed. The locations at which the inkjet assembly can be located include the upstream or downstream blanket or plate rollers, the sheet in the region of the impression roller, the infeed region or the outfeed region.

In an illustrative embodiment, a system and method for incorporating variable print onto sheets printed by a printing press includes a printer having an impression roller and a rotating plate and an inkjet head assembly located with respect to at least one of sheet outfeed locations, sheet infeed locations, and roller locations on the printer. The inkjet head assembly can be is located with respect to the infeed section so as to apply an inkjet image to a sheet. The sheet can registered on a front edge thereof with respect to the inkjet head assembly to assist in locating the printing. Likewise, the inkjet head assembly can be located with respect to the impression roller so as to apply an inkjet image to a sheet thereon, or it can be located so that the inkjet image is applied to the sheet after ink from a plate assembly is transferred to the sheet. The inkjet assembly can be adapted too apply ink over a portion of the sheet that receives ink from the plate assembly, or can be located to apply an inkjet image with respect to a blanket roller so as to transfer the inkjet image therefrom to the sheet. Illustratively, the inkjet assembly can be adapted to apply ink over a portion of the blanket roller that either (a) contains printing ink or (b) is free of printing ink. The inkjet assembly can also be located to apply an inkjet image with respect to a plate roller so as to transfer the inkjet image therefrom to a blanket roller and, in turn to the sheet. The inkjet assembly can generally be located to apply an inkjet image to the sheet in at least one of (a) an outfeed location and (b) a stacker location. The overall printing arrangement can further include an inkjet controller that controls application of the inkjet image by the inkjet assembly based upon registration information with respect to the sheet. The arrangement can also include a movement carriage constructed and arranged to move the inkjet assembly in a transverse direction with respect to sheet motion through the printer so as to transversely apply an inkjet image to the sheet in registration with sheet motion. Moreover, the arrangement can further include a roller drive mechanism operatively connected to each of the rotating plate, the impression roller and a blanket roller located therebetween, and a printer controller constructed and arranged to monitor an incremental position and a phase of at least one on the rotating plate, the impression roller and the blanket roller under movement of the drive mechanism and an inkjet assembly controller, responsive to the monitored incremental position and the phase, that moves the inkjet assembly transversely on the carriage and applies the inkjet image to the sheet in registration.

In an illustrative embodiment, a system and method for incorporating variable print onto a substrate includes an anilox roller having an array of cells constructed and arranged to receive a printing ink thereinto and an inkjet head assembly located with respect to at least a portion of the array of cells, constructed and arranged to selectively apply a compound from the inkjet head assembly to selected of the cells so as to vary a print image applied by the anilox roller to a substrate in communication with the anilox roller.

In another illustrative embodiment a system for screen-printing a substrate includes a screen-printing screen having an array of holes adapted to allow screen-print ink to pass therethrough and an inkjet head assembly mounted with respect to the screen so as to provide an inkjet compound to selected holes of the array of holes so as to allow for formation of a desired image on the substrate. The screen can be flat of formed into a drum and the inkjet compound in this embodiments, and others described herein can be at least one of an inkjet ink that passes through selected holes and an ink-phobic compound that blocks selected holes.

More generally, a system and method for variably printing defines providing a printing press component that applies printing ink from a printing ink source to a substrate and selectively applying an inkjet compound from an inkjet assembly that generates a predetermined print image based upon the presence of both the printing ink and the compound.

BRIEF DESCRIPTION OF THE DRAWINGS

The invention description below refers to the accompanying drawings, of which.

DETAILED DESCRIPTION

Figure 1:
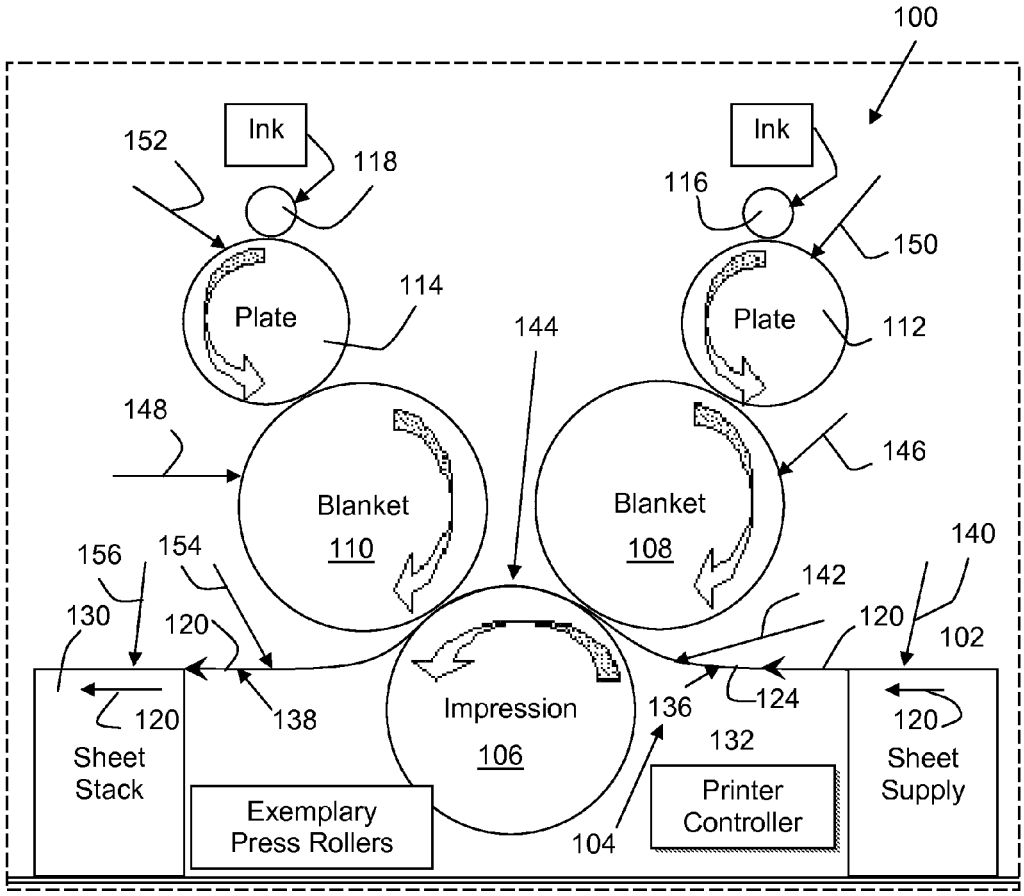
FIG. 1 is a schematic side view of an exemplary lithographic printing press arrangement showing potential locations for a variable-printing inkjet print engine in accordance with illustrative embodiments of the invention.

FIG. 1 details a novel system and method for of adapting inkjet printing to the traditional printing press according to various embodiments of the invention. The depicted arrangement provides many advantages over traditional printing arrangements with separate application of variable address and/or other information to the printed items. By way of example, the illustrative press arrangement 100 is based upon a model DI lithographic offset sheet-fed press available from Presstek, Inc. of Hudson, N.H. However, the principles of this invention are applicable to most makes, models and all types of presses, and afford identical advantages thereto. The illustrative press 100 contains a sheet supply 102, a printing engine 104, that includes an impression roller 106, upstream and downstream blanket rollers 108, 110 (used in an offset press), and associated plates/plate rollers 112, 114. Ink is supplied to each of the plates 112, 114 by respective ink rollers 116, 118. As shown, a depicted sheet is driven in a downstream direction (arrows 120) from the supply 102, through the roller section, where the inked plates 112, 114 transfer a registered print images to the sheet 124 via the blanket rollers 108, 110 (where they meet the impression roller 106), and finally to the output area, which can include a sheet stacker 130. A printer controller 132 monitors the drive and other associated printer components This invention addresses the novel aspects of applying variable inkjet printing at the various components in the press 100 that are in registration with the printed sheet. As noted above, any typical printing press has the following components in registration: a sheet feeder 102, an infeed section 136, a material impression cylinder 106, a blanket cylinder (if it is an offset press) 108, 110, an image-carrying component such as a printing plate 112, 114, and an output feed section 138. These components are well-known and understood by those skilled in the art of printing.

If the inkjet image is applied on the sheet feeder section (arrow location 140):

The sheet is not yet in register and the inkjet printing will not be precisely registered to the subsequent printing. The system can register to the front edge of the sheet which is what the press uses to register.

If the inkjet image is applied on the infeed section (arrow 142):

Once the sheet is gripped, all subsequent printing can be over the inkjet. The inkjet fluid will interact with subsequent printing. It has a chance to set into the paper before the other ink is applied. Much of the traditional ink and paper physics is unchanged with this inkjet application point.

If the inkjet image is applied on the impression cylinder section before the ink is applied (arrow 144):

This is typically the most stable point for the sheet in the press. However, the image was applied several components before this area so there are interactions with the geometry of the plate and blanket section (also termed the "plate assembly").

If the inkjet image is applied on the impression cylinder section after the ink is applied:

The inkjet ink is now on top of the traditional printing ink. The inkjet ink will interact with the other ink. The ink that is applied in areas where there is no printing much of the traditional ink and paper physics is unchanged with this application point. This is typically the most conventional location to apply the ink jet in prior arrangements. A novel aspect of this location is that the traditional ink is not yet dry. This provides the ability to interact with mostly the ink and be independent of the sheet substrate if the system inkjet-prints on top of the ink.

If the inkjet image is applied on the blanket section before the inked image is applied (arrow 148):

The system uses the ink from the inkjet to ultimately go on the final media. In this case, the system does not employ the inkjet to modify the standard press ink receptor locations on the image. Likewise, the system does not modify the oleophilic or hydrophobic characteristics of the ink receptor printing plate as accomplished by the prior art. Instead in this invention, the inkjet ink is mixed with the traditional press ink in programmable locations to achieve novel results. This location allows us to put inkjet material under the ink. This is useful for several reasons. If the ink is translucent, one can modify the color applied to the medium by mixing the press ink color with the inkjet color. If the ink is not viscous, it is possible to change its viscosity or its surface tension in many useful ways, for example to make it spread out the printed area it leaves or to tighten up the area. One can also change its final texture, creating a height dimension to the ink areas that are modified by the inkjet. There are many more modifications to the press ink possible that are understood by those skilled in the art.

If the inkjet image is applied on the blanket section after the ink is applied (arrow 146):

If the inkjet is on top of the traditional ink (see inked/printed area 260 on roller 202 in FIG. 2), the transfer of the inkjet ink is not dependent on the release characteristics of the blanket section ink.

If the inkjet image is applied on the plate section before the inked image is applied (arrow 150):

The prior art provides a number of systems that operate by applying inkjet prior to a plate section in litho printing and then drying the inkjet ink. The purpose of the inkjet in these patents is to modify the reception characteristics of the ink or water components. While such modification can also be accomplished by the illustrative invention it is contemplated the inks herein interact in the wet state, not dried. This invention also contemplates the advantages of possible interaction with the inks to change color or texture of the subsequent image. If the wet ink does change the reception characteristics of the ink or water, then that can used to effect variable information, impression-to-impression.

One of the advantages of applying the inkjet to the plate (either before or after the ink) is the water section will scrub off any residue inkjet ink on the next revolution of the plate cylinder.

If the inkjet image is applied on the plate section after the ink is applied (arrow 152):

The system does not alter the ink or water reception of the traditional ink. The inkjet ink can be in absolute registration with the traditional printing.

If the inkjet image is applied on the output section (arrow 154):

While this location is contemplated, it requires additional mechanisms to address the possibility of sheet registration and flutter problems not generally encountered inside the press.

If the inkjet image is applied on the stacker section (arrow 156):

Mechanisms should be provided to deal with any sheet-flutter or registration issues. However, the system can operate by registering to the front of the sheet, which comports to the location on the sheet at which the press typically registers.

Figure 2:
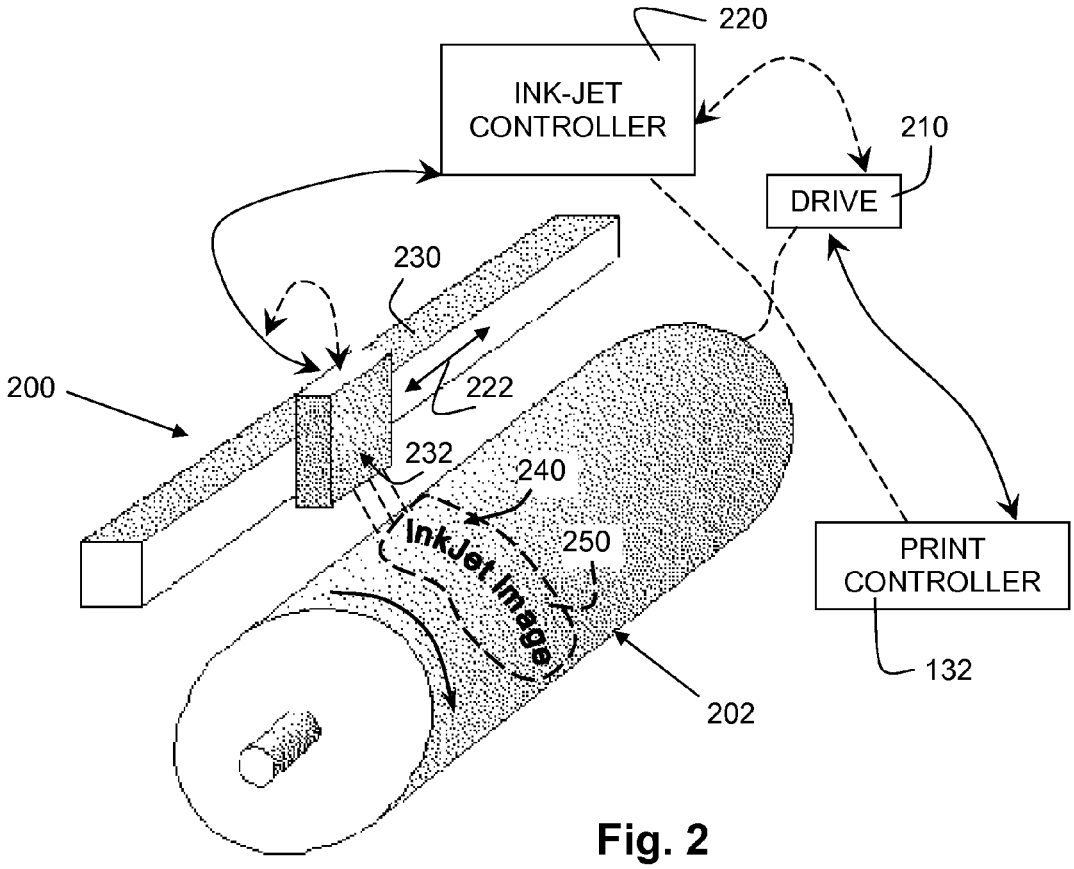
FIG. 2 is a schematic perspective view of an illustrative inkjet print engine located with a blanket roller, plate roller or impression roller according to various embodiments of the invention.

FIG. 2 describes a generalized inkjet print assembly 200 that can be applied to any of the regions (arrows 140, 142, 144, 146, 148, 150, 152, 154 and/or 156) described above. In this example, the region is one that is defined by a roller (impression, blanket or plate) and can include the underlying sheet (for example, in the case of the impression roller), or can be the roller surface itself. However, these techniques also apply to the infeed and outfeed regions as well as the sheet source and stacker/output location. As shown, the roller (and other printer components) is/are driven by the print drive mechanism 210. The printer's controller 132 monitors the incremental position and phase of the press image component. The controller reports the rate and phase of movement to the inkjet assembly controller 220. Based upon the selected position of the drive 210, the inkjet controller 220 registers transverse movement (double arrow 222) of the carriage 230 upon which the print head assembly 232 is mounted. The inkjet controller 220 also controls the laying down of print (240) on the selected surface (roller 202 in this example) in accordance with conventional techniques as the roller/sheet moves downstream with respect to the print head.

The print maintains its regularity across the image (despite the continuing rotation of the image) due to the fact that the illustrative inkjet heads have hundreds of nozzles in a two-dimensional array that allow a wide image to be printed as the image surface passes in front of the head. The width of the array in the transverse direction dictates the amount of movement along the carriage to complete an image. For an address block or similarly narrow message window, the image can be completed with minimal transverse movement. In this instance, the downstream movement of the image drives the formation of the image, with appropriate nozzles addressed as the portion of the image to be printed upon presents itself to the head. The controller addresses the appropriate nozzles (along the upstream-to-downstream direction to maintain a rectilinear print arrangement) as the head moves transversely across the printed area while the image simultaneously moves in a downstream direction. The controller generally monitors the incremental rotation and phase of the image surface to actuate the appropriate nozzles in the array.

Having now described the illustrative embodiments in detail, it should be clear that several advantages are provided by this novel invention. One advantage of the present arrangement is that no additional paper feeding components are required. Another advantage is that no registration components are needed to ensure sheets are properly registered between separate stations—rather all registration is integrated within a unitary feed path. A further advantage is that no material transport methods are needed. Rather, the system only requires knowledge of the start position and the incremental position of the carrier component to which the inkjet is applied. These carrier components, by the nature of the printing process are in very accurate registration.

Figure 3:
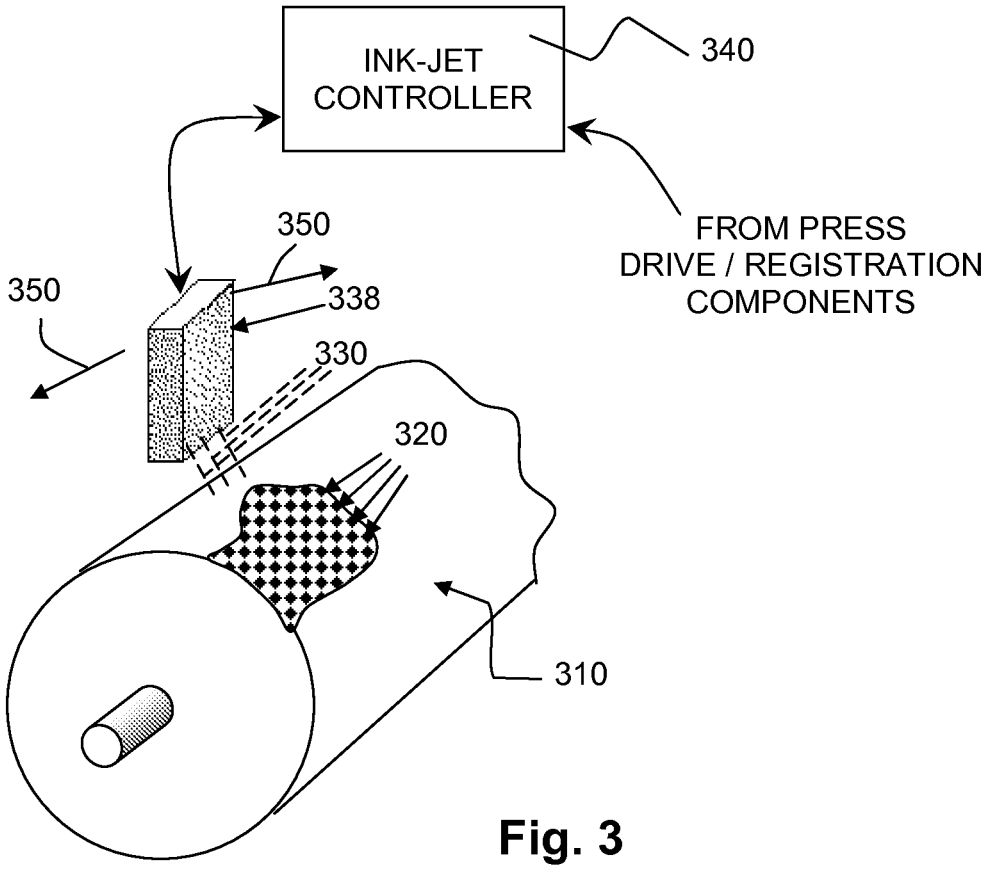
FIG. 3 is a schematic perspective view of an anilox roller receiving inkjet ink into selected cells thereof using a movable inkjet head assembly according to an illustrative embodiment.

Reference is now made more particularly to the plate cylinder (or roller) area as a source of applying inkjet imaging. In one embodiment, the plate is substituted with (or defined as) an anilox roll, i.e. a roll with ink-receptive cells cut into it, as is used in flexographic printing. An example of such a roll 310 is shown in FIG. 3. An exaggerated view of an array of wells or cells 320, which cover the roll surface, is generally depicted. The inkjet system 330 can be adapted to apply the image ink 330 directly into the cells rather than employing a conventional, inked-up flexo-relief plate, thus producing a variable imaging flexo-style printing via the deposition of inkjet ink directly to the cells. The roller 310 thereafter deposits the inkjet ink from the cells onto another substrate, such as a sheet, web, or offset printing surface. The inkjet controller 340 employs appropriate print and registration signals (registration being timed to the movement of the roller 310, or otherwise provided) to locate the cells-to-be-inked.

The selective inking of the cells 320 by various nozzles of the inkjet assembly 338 is coordinated with movement of the inkjet assembly along a carriage assembly (not shown, but similar to that shown in FIG. 2) as symbolized by the double-transverse-movement arrows 350. In this manner, the cells across the traverse width can be filled as the roller rotates. Transverse movement and firing of the nozzles is timed based upon the input registration information, which is illustratively based upon rotational position of the roller 310 and its underlying cells with respect to the position of the inkjet assembly 330. A doctor blade can be optionally provided, but typically, the accuracy of the inkjet filling operation can alleviate the need for such in this embodiment. The inkjet ink used in that and other embodiments should be formulated to remain wet and transferable during the latency period between ejection from the inkjet head assembly and deposition on the final substrate/print surface (sheet, web, etc.).

Figure 4:
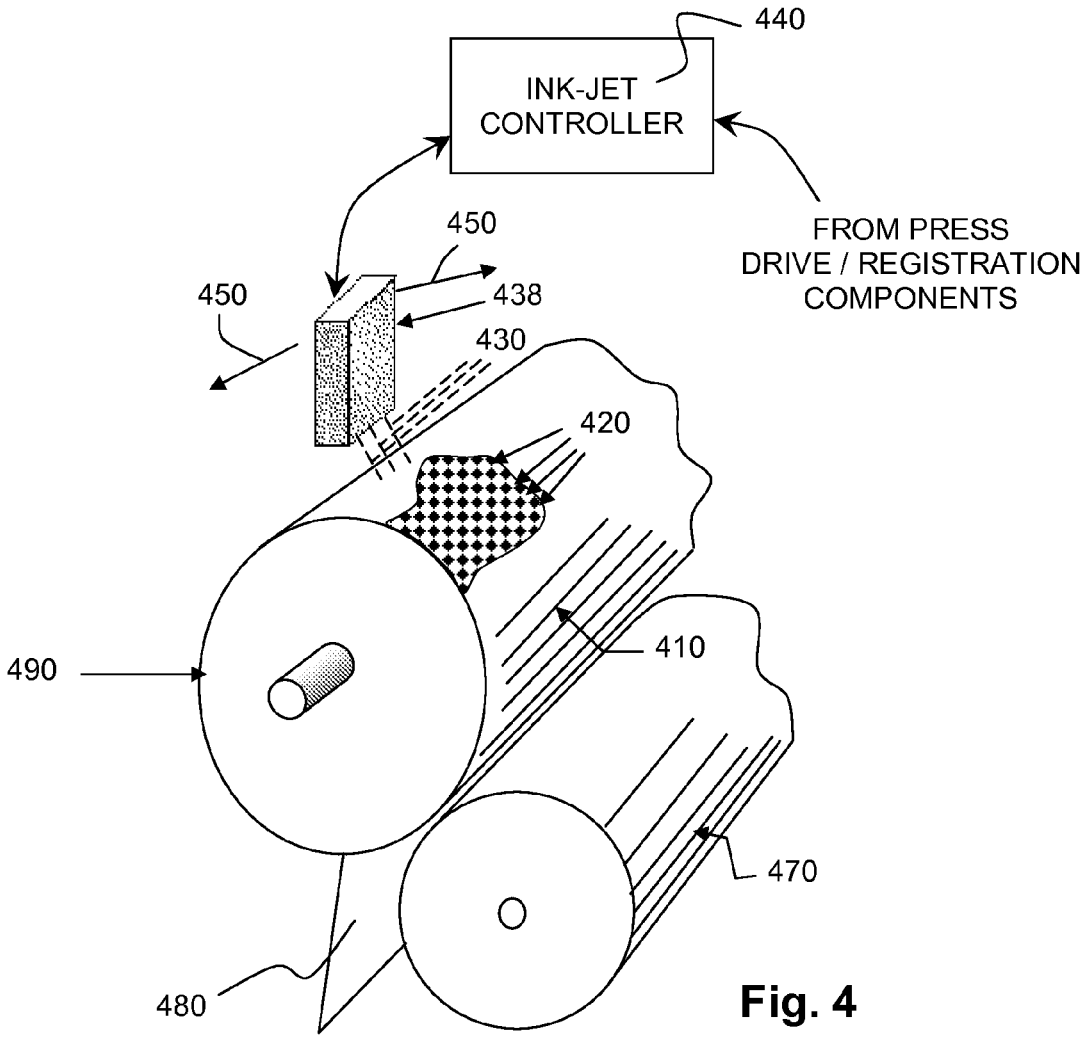
FIG. 4 is a schematic perspective view of an anilox roller receiving an ink-phobic compound into selected cells thereof so as to block printing ink from a source from entering the selected cells using an inkjet head assembly according to an illustrative embodiment.

Another embodiment is shown in FIG. 4. This embodiment employs the inkjet imaging assembly 438 (movable transversely as shown by arrows 450 and registering via the inkjet controller 440, as described above) to selectively block the cells 420 in an anilox roller 410 and apply traditional ink via an inking roller 470 (or equivalent structure) with a traditional doctor blade 480 to remove excess, as in gravure style printing. The inkjet can deposit a wax, a thermoplastic or other substances 430 that can be applied as a liquid, change phase rapidly to a solid. A variety of ink-phobic compounds deliverable by an inkjet assembly so as to block ink reception, and then be easily removed by heat, mechanical and/or chemical means/mechanisms, are expressly contemplated. For example, a meltable ink-phobic compound can be selectively ejected from the head nozzles into cells so as to block the reception of ink from the roller 470 into those cells. The compound is melted off by a heat source 490. This can allow one application of a variable image to be used to produce multiple copies all or a portion of the image. Where used on a portion of the image, the remaining image is optionally printed in a conventional manner by ink from the roller 470. This approach also allows the use of traditional gravure printing inks.

A similar embodiment could be adapted to rotary or flat silk-screen type printing (screen-printing), where the inkjet is applied through a previously applied image, or the inkjet creates a temporary ink-blocking image using an ink-phobic compound, so as to allow traditional silk screen ink to be extruded or squeegee ink to flow through the unblocked portion of the screen onto the substrate to form the inked printed image.

Figure 5:
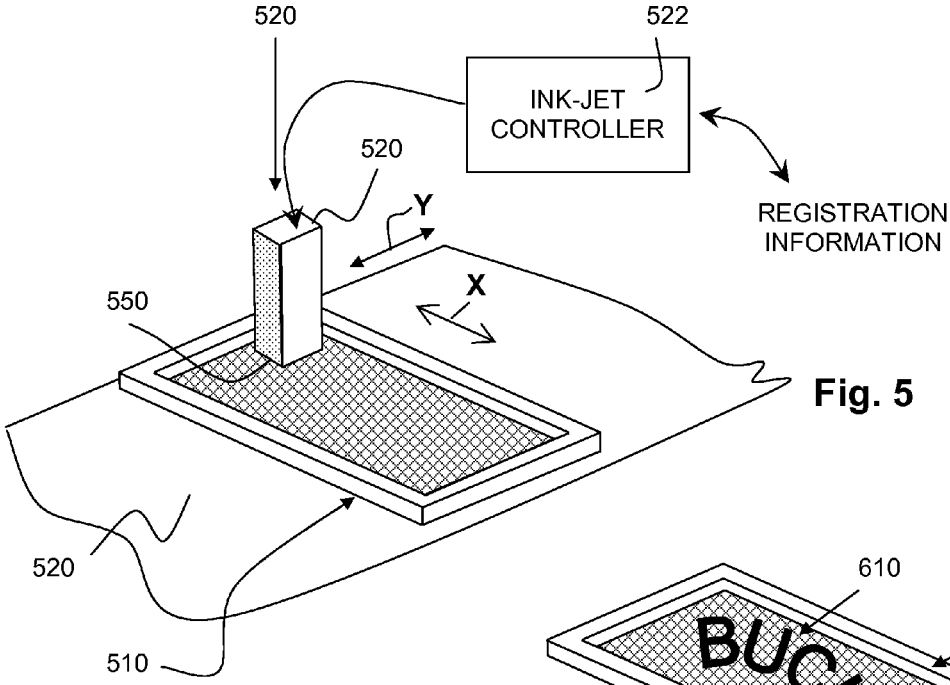
FIG. 5 is a schematic perspective view of a screen-printing arrangement integrating a movable inkjet head assembly that can be employed to provide inkjet ink through screen holes or to fill screen holes so as to block selected holes against ink passage therethrough according to illustrative embodiment.

With reference now to FIG. 5, a screen-printing arrangement 500 is shown schematically. The arrangement 500 includes a flat screen assembly 510 that overlies a substrate (paper sheets, web or another material) 520 so that an image can be transferred to the substrate. A movable inkjet head assembly 520 in communication with an inkjet controller 522 is temporarily or permanently located to overlie the screen 510. The screen can be any acceptable screen-printing screen formed from an appropriate material (metal, polymer, silk, etc.). The screen 510 includes an array of holes or pores at known locations that each allows ink to pass therethrough. In conventional screen-printing some of the holes can blocked when the screen is initially prepared to define a pattern in which ink can pass through unblocked holes, but cannot pass through blocked holes, allowing for selective printing of an image on the substrate 520. In this embodiment, the inkjet head 520 moves on an appropriate one-axis or two axis carriage assembly (axes X and Y in FIG. 5) that can be constructed in accordance with conventional principles. This allows the head to align with locations of the screen. Note, while not shown, the movement of the inkjet head assembly in this embodiment, or in association with the anilox roll assembly can be governed by programmed knowledge of the predetermined positions of holes (or wells), or by use of a conventional surface sensing system (optical, magnetic, sonar, etc.—not shown) that finds individual holes or wells on the surface of the plate or screen and aligns an appropriate nozzle therewith.

Thus, as shown in FIG. 5, the inkjet head assembly can either move across a blank or partially prepared (holes blocked to form a pattern) screen so as to provide an inkjet image to the substrate through the holes. In this embodiment, the nozzles of the head assembly, in coordination with the movement carriage direct the inkjet ink accurately through selected open screen holes other than those than are already be blocked by pre-preparation of the screen. This allows for the creation of a standalone inkjet image or a customized supplemental image using the inkjet (i.e. an image that supplement the screen-print image. An advantage of this approach is that the screen 510 closely contacts the substrate 520 and the head's nozzle element 550 closely overlies the screen, thereby avoiding air infiltration within the space between the nozzle and the substrate. This prevents premature drying of the inkjet ink, among other advantages. Note that the movement carriage assembly or conventional another mechanism can selectively move the inkjet head assembly into and out of relative engagement with the screen as needed. In a basic embodiment, the carriage raises the head and moves it aside, remote from the screen, in the X and/or Y direction.

Figure 6:
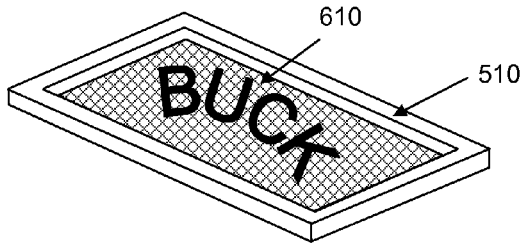
FIG. 6 is a schematic perspective view of the screen-printing arrangement of FIG. 6 showing either the production of an inkjet image that passes through the holes and onto a substrate, or the production of a blocked region that allows screen-printing ink to pass only through holes other than the selectively blocked holes.
Figure 7:
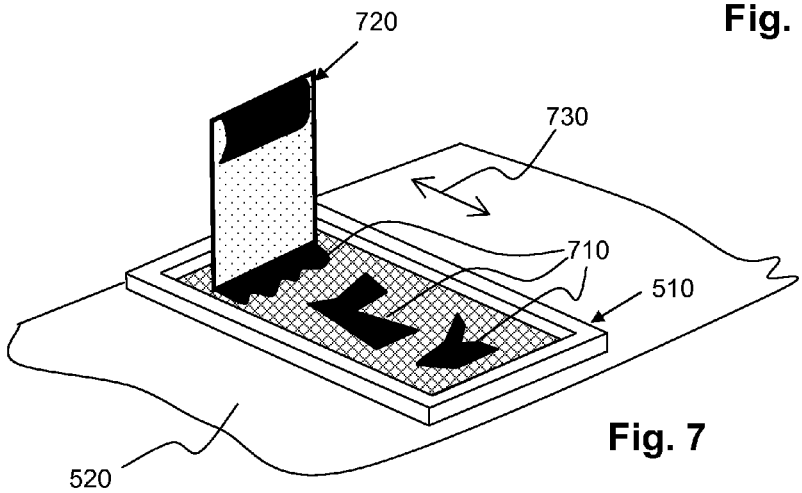
FIG. 7 is a schematic perspective view of a screen-print ink squeegee process with respect to the screen-printing arrangement of FIG. 5 following the selective blockage of screen holes.

In an alternate embodiment, in accordance with FIG. 5, the inkjet head assembly 520 directs an ink-phobic compound that selectively fills screen holes to form a screen-printing screen 510 (or a portion of a pre-prepared screen) in situ. As shown in FIG. 6, the blocked holes can generate a positive or negative pattern 610 (depending on which set of holes is blocked and which remains open) in the screen 510. As shown in FIG. 7, conventional screen-printing ink 710 is then applied to the screen 510. A conventional squeegee assembly 720 moves (double arrow 730) across the screen as generally shown to drive the ink 710 through the unblocked holes, and onto the substrate 520 in the form of a screen-printed pattern. The blocking compound provided by the inkjet head assembly can be permanent or can be adapted for removal using heat, chemical and/or mechanical mechanisms. It should also be clear that the use of selective inkjet-head-blocking of holes and inkjet-head-printing through holes can be combined in a single device or process. This can be achieved by changing heads, sources of inkjet ink/compound and/or using a plurality of heads with different compounds.

Figure 8:
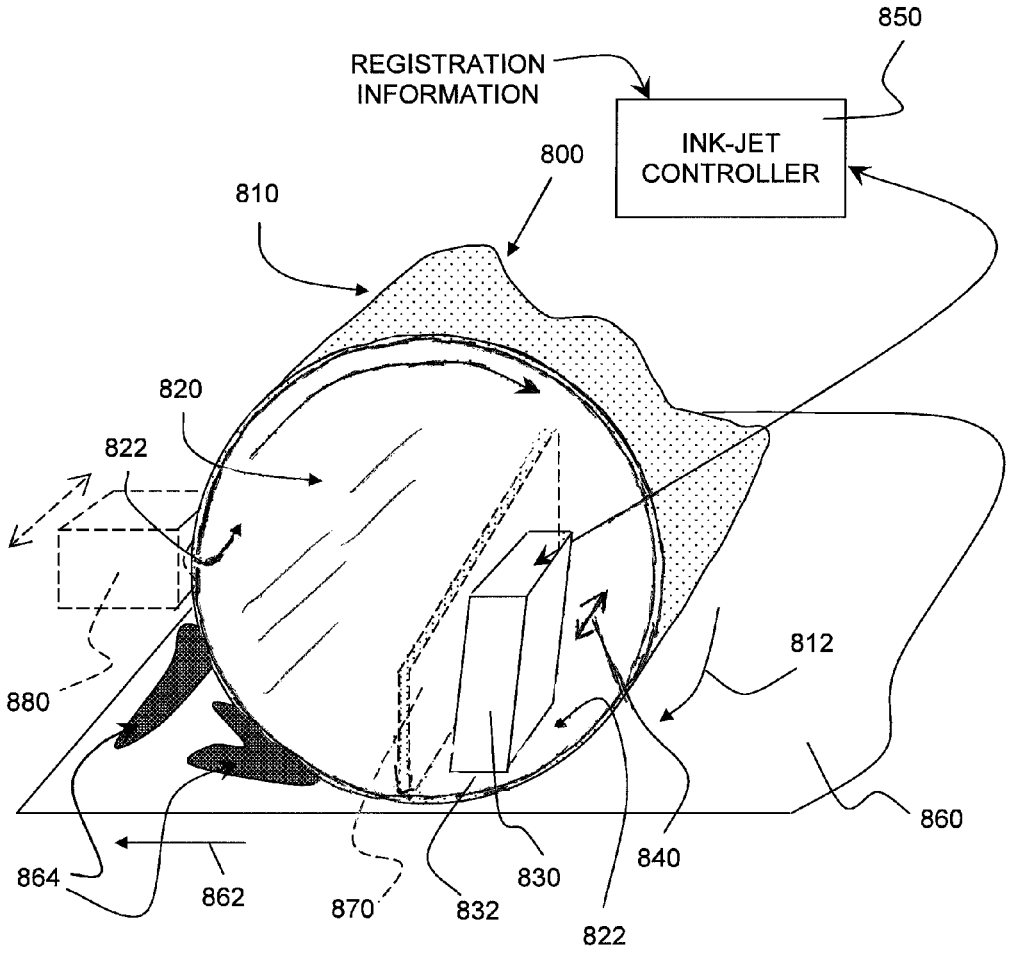
FIG. 8 is a schematic perspective view of a screen-printing arrangement employing a screen roller in which an inkjet assembly is positioned within the roller interior (and optionally along the exterior) for directing inkjet ink through selected screen holes or to block selected screen holes, and also including an optional squeegee within the roller interior for handling screen-printing ink that is passed through selected non-blocked holes.

Another illustrative embodiment of a screen-printing arrangement 800 that employs a movable inkjet head assembly is shown in FIG. 8. In general, the screen-printing element in this embodiment is a rotating (curved arrow 812) screen-printing drum or plate 810 that defines an array of selectively blocked and open holes or pores upon its surface. In the depicted embodiment, the central region 820 of the drum 810 is open or hollow, at least adjacent to the inner surface 822 of the drum 810. This allows the location of an inkjet head assembly 830 with a nozzle element 832 that closely overlies the inner surface 822 of the drum 810. The inkjet head assembly 830 is movable laterally (double arrow 840) under control of the inkjet controller 850, and by means of an appropriate movement carriage implemented according to conventional principles. The function of the inkjet head assembly 830 is similar to that of the embodiments depicted in FIGS. 5-7. The holes in the drum 810 can be fully open or selected holes can be blocked in a pre-preparation step. The head 830 moves laterally in registration with the rotation of the drum 810 to deliver inkjet ink via the nozzle element 832 into selected holes. The ink is passed through the holes in a precise manner to be deposited on the underlying substrate 860 (paper sheet, web or other material surface) that moves (arrow 862) in registration with the drum to produce a continuous image 864 thereon. The head assembly 830 can be adapted to move to a location remote from the interior surface of the drum when not in use using the transverse movement carriage or another conventional mechanism.

The inkjet head assembly 830 can be further adapted to direct a precise stream of an ink-phobic compound to selectively block holes of the drum. As such, a squeegee assembly 870 (shown in phantom) is provided to the interior 820 at or adjacent to the contact line of the drum 810 with the substrate 860. The squeegee 870 can be fixed (particularly where the head assembly is located remote from the contact line, or movable. A screen-print ink source (not shown) is used to apply screen-print to the interior of the drum so as to pass under action of the squeegee 870 through the unblocked holes and onto the substrate 860. As described above, appropriate thermal, chemical and/or mechanical mechanisms can be employed to remove the ink-phobic compound from blocked holes after a particular print run is completed, so as to allow for reuse of the drum in a further discrete print run. It is contemplated that one or more movable (or fixed) heads can be mounted at various locations about the exterior perimeter of the drum 810 (such as inkjet head assembly 880—shown in phantom). Such heads can be used, for example, for selective blocking of drum screen holes from the exterior face of the drum. These can be used alone or in combination with one or more internally positioned inkjet head assemblies as described above. A variety of other configurations and control schemes can be employed in alternate embodiment that should be clear from the description herein.

Notably, the above-described embodiments can be used to solve one of the most difficult problems encountered with inkjet technology in obtaining high-speed printing. At high speeds the ejected ink drops have to penetrate a boundary layer of air that flows with the media. It has been contemplated to pass the media through a vacuum chamber. However, several disadvantages arise because the medium can be very flexible and fragile—such as 0.003-inch thick paper—and distorts under the vacuum's influence. In contrast, by applying the inkjet imaging as described above, a very small gap, on the order of 0.0005 inches or less, can be created between a vacuum chamber and the cylinder. Thus, the inkjet imaging can be applied in a nearly airless environment, eliminating nearly all the effect of wind on the imaging quality.

The imaging rolls described herein can also be porous or otherwise allow vacuum to be drawn through its surface to help the inkjet ink stick and remain in place despite centripetal and wind forces. The inkjet stream can also be attracted to the roll by electrostatic or magnetic forces in conjunction with the inkjet ink's characteristics to also overcome such high-speed imaging problems.

It should be clear that the various embodiments described above, by combining the versatility of inkjet printing with more-conventional plate and roller-based techniques affords significant advantages. The above-described arrangements allow all or a portion of the overall mage to be varied, while still providing the desired product produced by conventional plate and roller press techniques. In further embodiments, then inkjet assembly serves to control the placement of the plate and roller (gravure and screen-print) inks themselves. The compact size of the inkjet arrangement also enables it to be located at a large number of positions around a traditional press arrangement.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the transport mechanism used for the inkjet is highly variable, and can be shaped and sized to integrate with the particular location at which it is mounted in the printer. Also the inkjet head can be a standalone unit with encased ink supply in a cartridge form, or can be tank-fed in alternate embodiments. Likewise, multiple inkjet heads can be used in a grouping that operate on a discrete location, or at separate locations around the press. Accordingly, this description is meant to be taken only by way of example, and not to otherwise limit the scope of this invention.

What is claimed is:

1. A system for incorporating variable print onto sheets printed by a printing press comprising:

a printer having an impression roller and a rotating plate, the plate applying press ink to the impression roller according in the form of a plate image; and an inkjet head assembly located on a carriage that spans at least a portion of a width of the printer, the inkjet head assembly being located with respect to at least one of sheet outfeed locations, sheet in feed locations, and roller locations on the printer, the inkjet head assembly applying variable printing that at least in part overlies the press ink to define printed sheets having a press ink pattern and a variable inkjet pattern combined thereon.

2. The system as set forth in claim 1 wherein the inkjet head assembly is located with respect to one of the infeed locations so as to apply an inkjet image to a sheet.

3. The system as set forth in claim 2 wherein the sheet is registered on a front edge thereof with respect to the inkjet head assembly.

4. The system as set forth in claim 1 wherein the inkjet head assembly is located with respect to the impression roller so as to apply an inkjet image to a sheet thereon.

5. The system as set forth in claim 4 wherein the inkjet head is located so that the inkjet image is applied to the sheet after ink from a plate assembly is transferred to the sheet.

6. The system as set forth in claim 5 wherein the inkjet assembly applies ink over a portion of the sheet that receives ink from the plate assembly.

7. The system as set forth in claim 1 wherein the inkjet assembly is located to apply an inkjet image with respect to a blanket roller so as to transfer the inkjet image therefrom to the sheet.

8. The system as set forth in claim 7 wherein the inkjet assembly applies ink over a portion of the blanket roller that either (a) contains printing ink or (b) is free of printing ink.

9. The system as set forth in claim 1 wherein the inkjet assembly is located to apply an inkjet image with respect to a plate roller so as to transfer the inkjet image therefrom to a blanket roller and, in turn to the sheet.

10. The system as set forth in claim 9 wherein the inkjet assembly applies ink over a portion of the of the plate roller that either (a) contains printing ink or (b) is free of printing ink.

11. The system as set forth in claim 1 wherein the inkjet assembly is located to apply an inkjet image to the sheet in at least one of (a) an outfeed location and (b) a stacker location, and further including an inkjet controller that controls application of the inkjet image by the inkjet assembly based upon registration information with respect to the sheet.

12. The system as set forth in claim 1 wherein the carriage is constructed and arranged to move the inkjet assembly in a transverse direction with respect to sheet motion through the printer so as to transversely apply an inkjet image to the sheet in registration with sheet motion.

13. The system as set forth in claim 12 further comprising a roller drive mechanism operatively connected to each of the rotating plate, the impression roller and a blanket roller located therebetween, and a printer controller constructed and arranged to monitor an incremental position and a phase of at least one of (a) the rotating plate, (b) the impression roller and (c) the blanket roller under movement of the drive mechanism and an inkjet assembly controller, responsive to the monitored incremental position and the phase, that moves the inkjet assembly transversely on the carriage and applies the inkjet image to the sheet in registration with a press ink image so that the inkjet image and a press ink image are combined on each of the sheets.

14. The system as set forth in claim 4 further comprising another rotating plate with respect to the impression roller, the plate applying another press ink to the impression roller in the form of another plate image on the impression roller.

* * * * *